United States Patent [19]

Altoz

[11] Patent Number: 4,899,812

[45] Date of Patent: Feb. 13, 1990

[54] SELF-SECURING TURBULENCE PROMOTER TO ENHANCE HEAT TRANSFER

[75] Inventor: Frank E. Altoz, Catonsville, Md.

[73] Assignee: Westinghouse Electric Corp., Pittsburgh, Pa.

[21] Appl. No.: 240,282

[22] Filed: Sep. 6, 1988

[51] Int. Cl.[4] ..... F28B 3/02

[52] U.S. Cl. ..... 165/109.1; 165/46; 138/38

[58] Field of Search ..... 138/38; 165/109.1, 80.4, 165/46

[56] References Cited

U.S. PATENT DOCUMENTS

| | | | |
|---|---|---|---|
| 1,862,219 | 6/1932 | Harrison | 165/109.1 |
| 2,359,288 | 10/1944 | Brinen | 138/38 |
| 2,480,706 | 8/1949 | Brinen | 165/179 |
| 3,783,938 | 1/1974 | Chartet | 138/38 |
| 4,352,378 | 10/1982 | Bergmann et al. | 138/38 |

FOREIGN PATENT DOCUMENTS

| | | | |
|---|---|---|---|
| 995294 | 11/1951 | France | 165/79 |

*Primary Examiner*—Ira S. Lazarus
*Assistant Examiner*—Christopher Hayes
*Attorney, Agent, or Firm*—W. G. Sutcliff

[57] ABSTRACT

A device for positioning within the interior of a conduit for enhancing heat transfer between the conduit and an enclosed flowing coolant fluid comprised of a longitudinal member having a plurality of protuberances for generating turbulent flow within the conduit with the longitudinal member being resiliently secured within the conduit such that the force of the fluid flow will not displace the member.

Design of the device is such that installation or removal from a tube may be easily accomplished by merely sliding the device in or out of the tube.

8 Claims, 4 Drawing Sheets

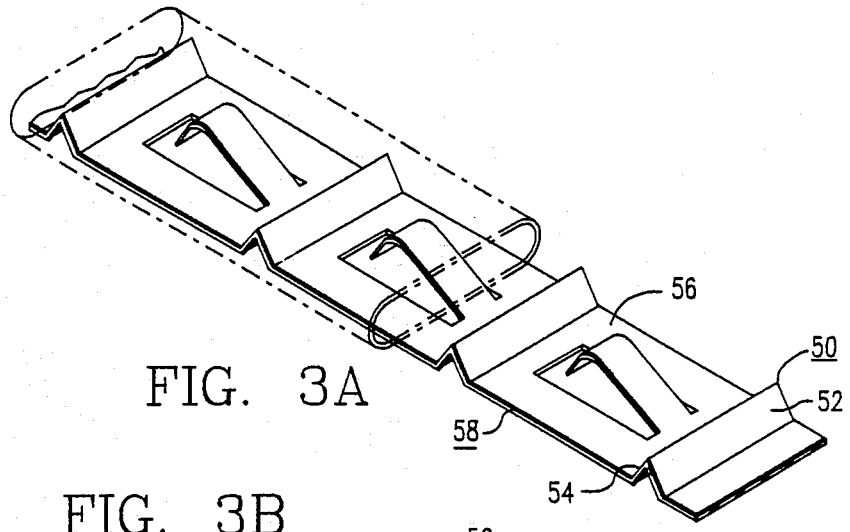
FIG. 3A
FIG. 3B
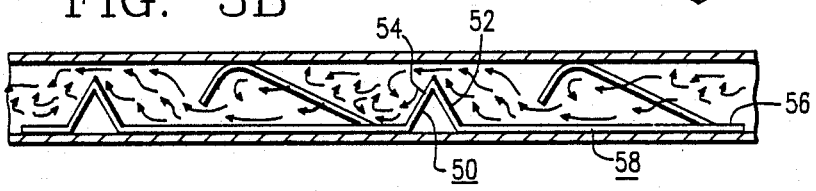
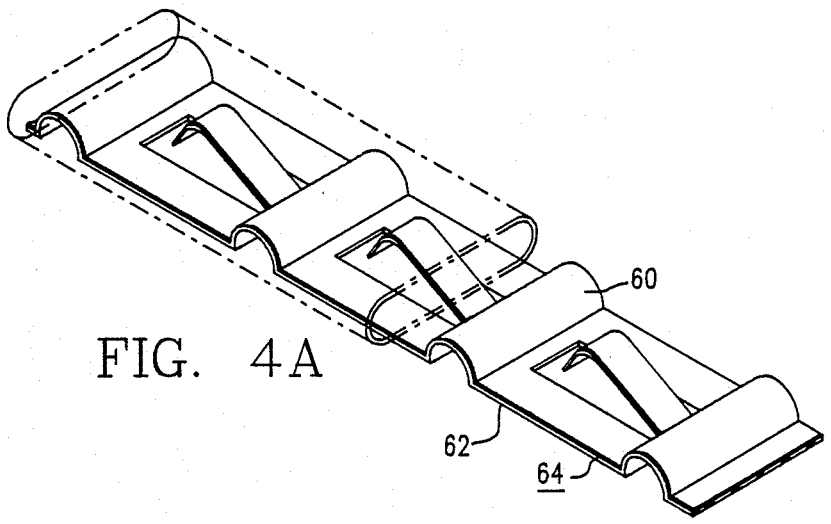
FIG. 4A
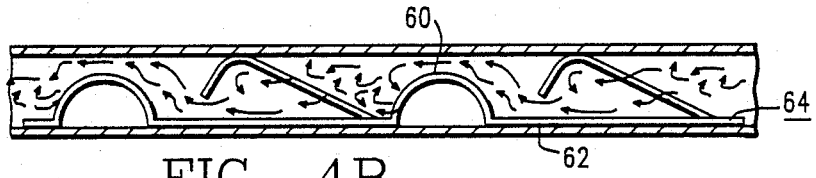
FIG. 4B

SELF-SECURING TURBULENCE PROMOTER TO ENHANCE HEAT TRANSFER

STATEMENT OF GOVERNMENT INTEREST

This invention was made with Government support under Contract No. F33657-86-C-2085 awarded by the Department of the Air Force. The Government has certain rights in this invention.

FIELD OF THE INVENTION

This invention relates to a device for enhancing heat transfer between a moving fluid and an enclosing channel through the creation of turbulent fluid flow.

BACKGROUND OF THE INVENTION

When a fluid flows along a surface, irrespective of whether the flow is laminar or turbulent, the particles in the vicinity of the surface are slowed down by virtue of viscous forces. The fluid particles adjacent to the surface stick to it and have zero velocity relative to the surface. Other fluid particles attempting to slide over them are retarded as a result of an interaction between faster and slower moving fluid. The effects of the viscous forces originating at the surface from the non-moving fluid extend into the body of fluid, but a short distance from the surface the velocity of the fluid particles approaches that of an undisturbed free stream. The fluid contained in the region of substantial velocity change is called the boundary layer. Given a typical heat exchanger tube with a moving fluid as a coolant, the phenomena of a boundary layer significantly affects the efficiency of the heat transfer between the moving fluid and the tube. Unlike moving fluid which transfers heat through convection and conduction, the boundary layer portion against the surface essentially is a layer of non-moving fluid directly against the wall of the tube which allows heat transfer only through conduction. Furthermore, laminar fluid flow which may exist in the tube creates a thicker boundary layer of relatively stagnant fluid than does turbulent flow. Consequently, in order to maximize the heat transfer efficiency between a tube and the enclosed cooling fluid, absent other factors an ideal situation would involve complete turbulence of the moving fluid throughout the length of the heat exchanger tube. An additional advantage of turbulent flow, aside from the reduction of the boundary layer thickness, is that the fluid is mixed by the turbulence. This promotes a more uniform fluid temperature distribution throughout the tube and this, in itself, is conducive to better heat transfer.

This phenomena of deliberately creating a turbulent coolant flow within a heat exchanger tube has been known in the art for quite some time and the devices used to create the turbulent flow have been numerous. Typically, each of the devices used in the past required installation at the time the heat exchanging device was fabricated or required substantial modifications for the installation after the heat exchange device was fabricated. A device is needed for installation within heat exchanger tubes that will effectively create turbulent flow of the moving fluid but also be easily installed and, if necessary, easily removed.

It is an object of this invention to provide a device suitable for creating a turbulent fluid flow within a tube having a moving fluid. It is further object of this invention to provide a turbulence generating device that may be easily inserted and removed from a tube. It is a further object of this invention to provide a turbulence generating device that may be inserted and secured within a tube using no permanent connections. It is a further object of this invention to provide a turbulence generating device that is of relatively simple design such that fabrication and production is relatively inexpensive.

SUMMARY OF THE INVENTION

The self-securing turbulence promoting device for positioning within the interior of a conduit for enhancing heat transfer between the conduit and an enclosed flowing coolant fluid is comprised of a longitudinal member having a plurality of protuberances for generating turbulent flow within the conduit and also having a means for resiliently securing the longitudinal member within the conduit such that the force of the fluid flow will not displace the member.

Design of the device is such that installation or removal from a tube may be easily accomplished by merely sliding the device in or out of the tube.

BRIEF DESCRIPTIONS OF THE DRAWINGS

FIGS. 3A and 3B illustrate still another embodiment of the invention utilizing spike protuberances to generate turbulence.

FIGS. 4A and 4B illustrate still another embodiment of the invention utilizing curved protuberances to generate turbulence.

Figure 1A:
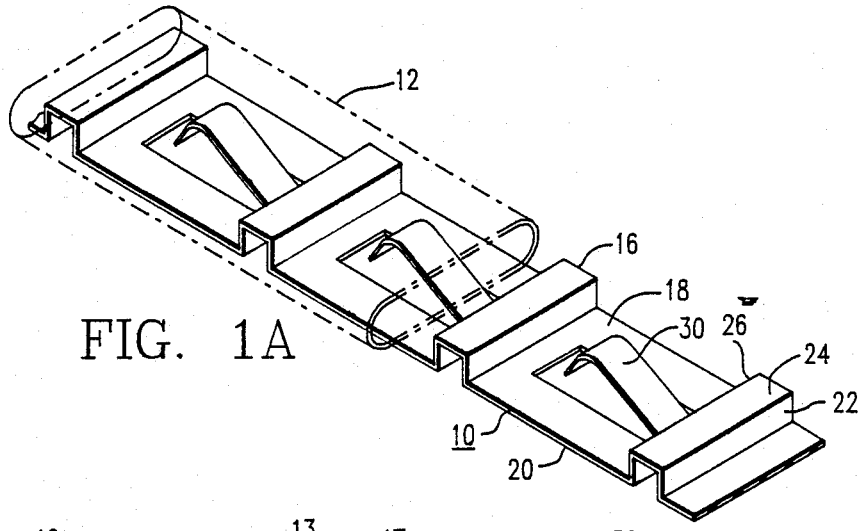
FIGS. 1A and 1B show an isometric view and a side view, respectively, of one embodiment of the invention using rectangular protuberances to generate turbulence.
Figure 1B:
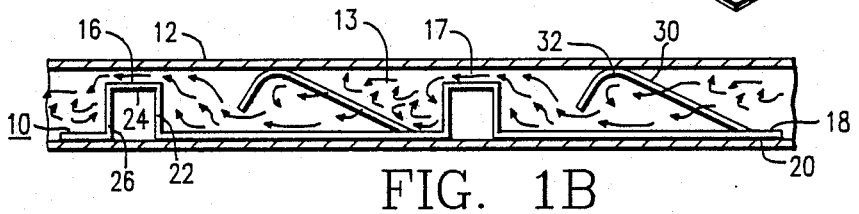

Referring now to FIGS. 1A and 1B, the invention will be explained. The goal of this invention provide a turbulence promoting device that is self-securing and one that may be easily installed and removed from a tube. A longitudinal member 10 used for placement within a heat exchanger tube 12 enclosing a moving coolant fluid 13 (FIG. 1B) is designed to slide in and out of the tube 12. For compatibility with member 10, the tube 12 must have an approximately rectangular-shaped cross-section. This could be accomplished either by using a rectangular conduit (not shown) or by using a tube whose shape resembles that of an an oval similar to that of tube 12. Note that while an oval-shaped tube 12 is used here, any conduit or enclosed channel could be used and only minor modifications to the longitudinal member 10 would be required.

The longitudinal member 10 is a continuous strip of material conformed to perform a dual purpose. First of all the member is shaped such that rectangular protuberances 16 are formed along its length at regular intervals. The longitudinal member 10 has top surfaces 18 and an approximately planar bottom surface 20. A typical rectangular protuberance 16 consists of a segment 22 oriented in a direction perpendicular to the plane formed by the bottom surface 20 followed by a segment 24 parallel to the plane formed by the bottom surface 20 and then followed by a segment 26 oriented perpendicular to the plane. When the longitudinal member 10 is inserted into the tube 12 and fluid flow is initiated, the rectangular protuberances 16 act to create partial restrictions 17 to the flow within the tube 12 and in the process generate turbulence of the flowing fluid 13.

For maximum heat transfer between the fluid and the tube 12 walls maximum turbulence is desired. The degree of turbulence is dependent on the size of the flow-restricting rectangular protuberance 16 within the tube. A larger rectangular protuberance 16 relative to the tube 12 creates a smaller restriction 17 which in turn generates greater turbulence. A limiting factor on the amount of turbulence is the pressure drop of the fluid caused by each of the protuberances 16 within the tube 12. Given a maximum allowable pressure drop of the fluid across the length of the tube 12, the size of the rectangular protuberances 16 may be adjusted such that the allowable pressure drop across the length of the tube 12 is not exceeded. In this manner the maximum amount of turbulence is generated for a given pressure drop across the length of the tube 12. The width of the longitudinal member 10 is dictated by the width of the tube 12 into which the member 10 is placed and ideally should fit with minimum clearance.

Clearly if there is a gap for fluid passage between the rectangular protuberance 16 and the tube 12 wall in which fluid can pass then there is also space by which the member 10 may freely move within the tube 12. In order to prevent movement of the member 10 within the tube 12 cantilevered segments 30 exist along the length of the member 10. Each cantilevered segment 30 is oriented at an angle above the top surfaces 18 such that the end of the section 30 is located at a height above the top of the rectangular protuberance 16. The segment 30 must be high enough that upon insertion into the tube 12 the cantilevered section 30 is deflected downward by the tube 12 wall and forced into a compressed state such that the longitudinal member 10 is held within the tube 12 by static friction from the spring force generated through the cantilevered section 30. With a plurality of cantilevered sections 30 along the length of the member 10, the longitudinal member 10 may be held in place within the tube 12 without being displaced by the fluid flow. Note that previously no material requirements for the longitudinal member were discussed. Because this cantilevered section 30 must be resilient, the material of the longitudinal member 10 from which the cantilevered section 30 is a part, must be of a material that provides elasticity sufficient for the cantilevered sections 30 to hold the longitudinal member 10 in place within the tube 12. Note that for ease of insertion the cantilevered section 30 has a curved end 32. This permits the longitudinal member 10 to be inserted within the tube 12 from either direction. FIG. 1B shows a side view of the longitudinal member 10 placed within the tube 12. Note the cantilevered sections 30 within the tube 12 are in a compressed state.

Figure 2A:
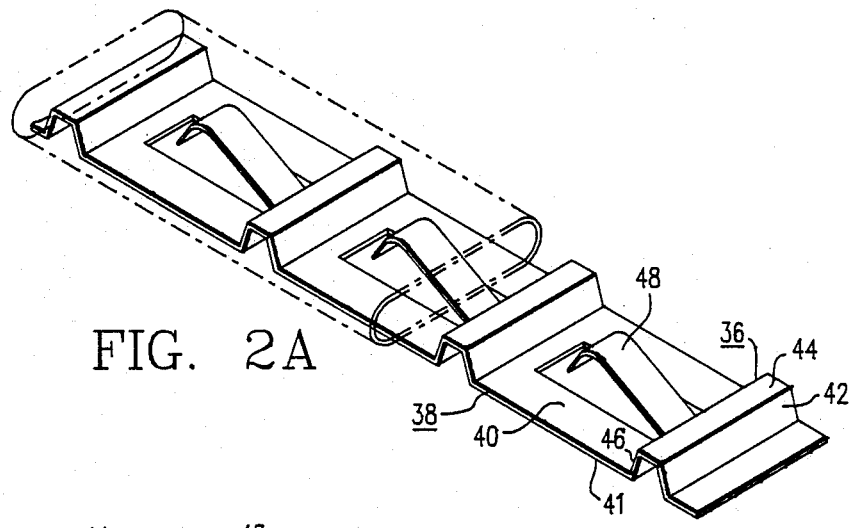
FIGS. 2A and 2B illustrate another embodiment of the invention utilizing ramped protuberances to generate turbulence.
Figure 2B:
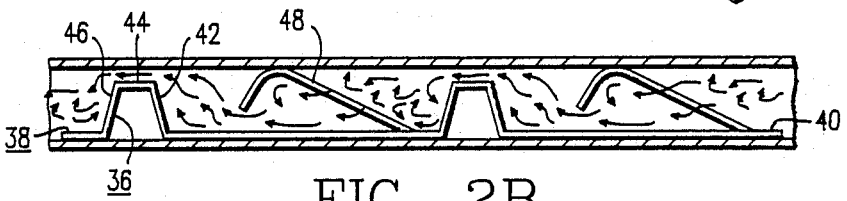

While the rectangular protuberance 16 illustrated in FIGS. 1A and 1B is the preferred embodiment of this invention a number of other configurations are possible. FIGS. 2A and 2B show a similar arrangement to that of FIGS. 1A and 1B except the rectangular protuberance 16 of FIG. 1 has been replaced by a ramped protuberance 36 on a longitudinal member 38. Instead of having perpendicular segments from the planar top surface 18 as in FIGS. 1A and 1B, this ramped protuberance 36 is on a longitudinal member 38 which has a top surface 40 and a bottom surface 41 which approximately defines a plane. The protuberance 36 has an upwardly sloping section 42 followed by a section 44 parallel to the bottom surface 40 plane and then followed by a downwardly sloping section 46. The means for securing the longitudinal member 38 within a tube are by using cantilevered sections 48 which are identical to that means discussed with figures lA and IB.

FIGS. 3A and 3B present another embodiment of this invention. In this embodiment the rectangular protuberance 16 of FIGS. 1A and 1B is replaced by a spiked protuberance 50 having an upwardly sloped section 52 followed by a downwardly sloped section 54 from a top surface 56 on a longitudinal member 58. Again, the means for securing the longitudinal member 58 within a tube are the same as those previously discussed.

Still another embodiment is that presented in FIGS. 4A and 4B. Here the rectangular protuberance 16 presented in FIGS. 1A and 1B is replaced by a curved protuberance 60 protruding from a plane approximately defined by a bottom surface 62 of a longitudinal member 64. Just as before the means for securing the longitudinal member 64 into a tube is the same as that previously discussed.

Figure 5A:
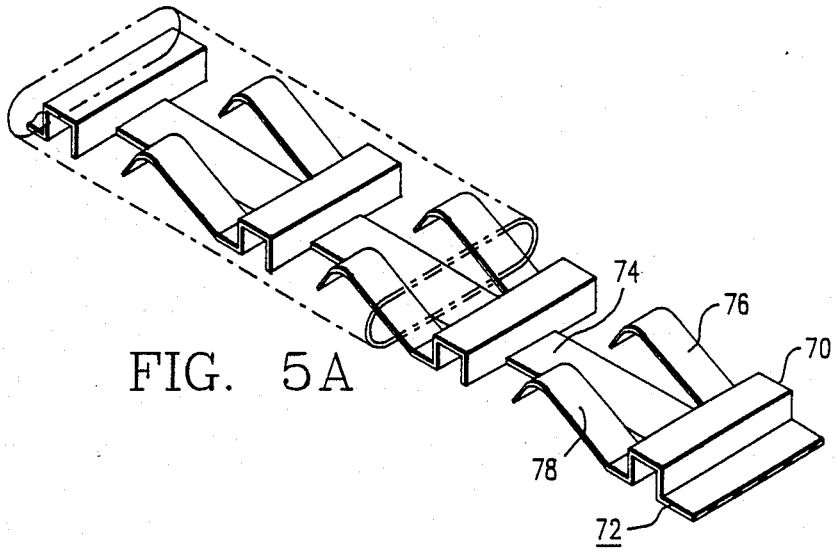
FIGS. 5A and 5B illustrate still another embodiment of the invention having a different arrangement for securing the member within the tube.
Figure 5B:
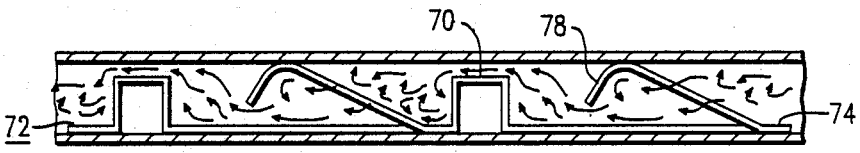

FIGS. 5A and 5B present still another embodiment of the invention. While in this embodiment the rectangular protuberance 16 of FIGS. 1A and 1B is utilized, it is identified as item 70 and protrudes from a longitudinal member 72 having a top surface 74. However, the means for securing the longitudinal member 72 into the tube is different. In this embodiment, two separate cantilevered sections 76 and 78 are utilized. One advantage of this arrangement over the previous arrangement is that the cantilevered sections 76 and 78 can provide twice the compression available through only one spring and furthermore act to increase the turbulence within the tube.

While the configuration of the turbulence promoter illustrated in FIGS. 1 through 5 is clearly adaptable to a tube having continuous walls, this turbulence promoter may also be successfully utilized in heat exchanger tubes having flexible walls that upon tube pressurization expand radially and directly contact a heat source. This type of a tube is particularly useful to cool a plurality of heat sources.

Figure 6A:
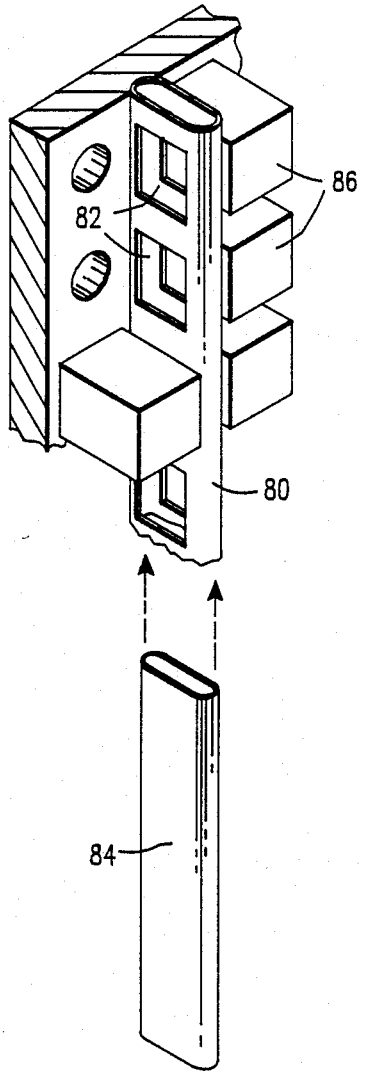
FIGS. 6A and 6B illustrate an expandable tube arrangement to which the invention may be applied.
Figure 6B:
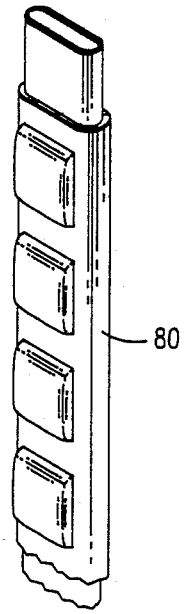

One arrangement suitable for this is shown in FIGS. 6A and 6B. An approximately oval shaped tube 80 having a series of openings 82 has inserted within a sleeve 84 made of elastic material. Upon pressurization with a cooling fluid, the portion of the elastic sleeve 84 located within the openings 82 of the tube 80 expands so that the elastic material extends beyond the boundaries of the tube 80. The tube 80 and openings 82 may be designed such that when placed next to a series of heat sources 86 the elastic material expands and directly contacts the heat sources 86.

Figure 7:
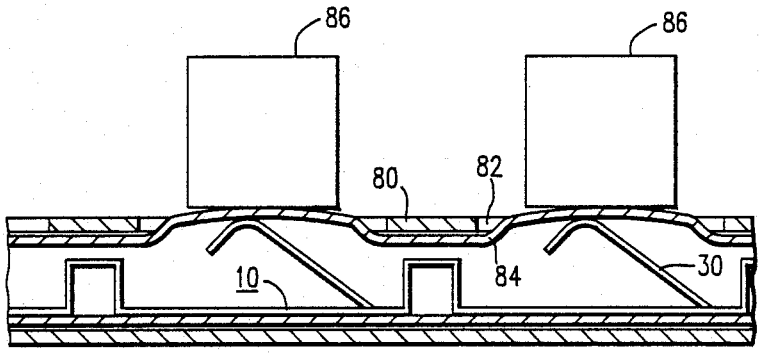
FIG. 7 is a sketch showing a cross-section view of the tube in FIGS. 6A and 6B with the turbulence promoter of this invention in place.

FIG. 7 shows a cross-section view of the turbulence promoter indicated by the longitudinal member 10 in FIGS. 1A and 1B positioned within the tube 80 and sleeve 84 arrangement in FIGS. 6A and 6B so that the cantilevered sections 30 are located within the openings 82 of the tube 80. Upon fluid pressurization of the sleeve 84, the sleeve elastic material expands through the openings 82 in the tube 80 so that the elastic material contacts one of a series of heat sources 86. By utilizing the design of the turbulence promoters taught in this invention, the cantilevered sections 30, since they are in a compressed position, relax slightly upon sleeve 84 expansion but continue to follow the contour of the expanding sleeve 84 thereby securing the turbulence promoter indicated by item 10 even after the sleeve 84 has expanded to accommodate the pressurized flow.

Note that while the turbulence promoter shown in FIGS. 1A and 1B was discussed for its application in FIG. 7, any of the turbulence promoters discussed in FIGS. 1–5 would be adequate for this application.

Although this invention has been described with reference to a specific embodiment thereof, numerous modifications are possible without departing from the invention, and it is desirable to cover all modifications falling within the spirit and scope of this invention.

What is claimed is:

1. A self-securing turbulence-promoting device for positioning within the interior of a conduit adapted to be filled with a fluid flowing therethrough to enhance heat transfer between the conduit walls and the moving fluid comprising:

(a) a longitudinal member having a length, a width, top surfaces and an essentially planar bottom surface, the member further having a plurality of protuberances along the member length, each protuberance extending across the width of the member and to a predetermined height forming a gap between the protuberance and the conduit wall, which act as restrictions to the fluid flow within the conduit and generate fluid turbulence; and (b) means for resiliently securing the longitudinal member within the conduit such that the force of the fluid flow will not displace the member, wherein means for resiliently securing is comprised of at least one upwardly sloped cantilevered segment made of resilient material and extending from the plane defined by the bottom surface, the segment having a width less than that of the member and having a length sufficient for the at least one upwardly sloped segment to extend above the height of the protuberances and to contact the conduit wall and urge the planar bottom surface of the member against an opposite wall such that the member is self-secured within the conduit.

2. The apparatus according to claim 1, wherein each protuberance is comprised of a short length of an upwardly sloping section extending from a plane defined by the bottom surface followed by a section parallel to the plane and followed by a downwardly sloping section to the plane.

3. The apparatus according to claim 2, wherein the upwardly sloping section and the downwardly sloping section are perpendicular to the plane defined by the bottom surface.

4. The apparatus according to claim 1, wherein each protuberance is comprised of a short length of an upwardly sloping section extending from the plane defined by the bottom surface followed by a downwardly sloping section to the plane.

5. The apparatus according to claim 1, wherein each protuberance is comprised of a short length having a curved shape.

6. A self-securing turbulence-promoting device for positioning within the interior of a conduit filled with a moving fluid to enhance heat transfer between the conduit walls and the moving fluid comprising:

(a) a longitudinal member having a plurality of protuberances for generating turbulent flow within the conduit, each protuberance comprised of a short length along the member of an upwardly sloping section extending from a plane defined by the bottom surface followed by a section parallel to the plane and followed by a downwardly sloping section to the plane; and (b) means for resiliently securing the longitudinal member within the conduit such that fluid flow will not displace the member, means comprised of an upwardly sloped cantilevered segment extending from the member plane defined by the bottom surface having a width less than that of the member and having a length sufficient for the upwardly sloped segment to contact the conduit wall and urge the planar bottom surface of the member against an opposite wall such that the member is self-secured within the conduit.

7. A heat transfer enhancement arrangement comprising:

(a) a conduit; and (b) a self-securing turbulence-promoting device positioned within the interior of the conduit, such that when the conduit is filled with a moving fluid heat transfer is enhanced between the conduit walls and the moving fluid, comprising:

(i) a longitudinal member having a plurality of protuberances for generating turbulent fluid flow within the conduit, wherein the longitudinal member is comprised of a strip of material having top surfaces and an essentially planar bottom surface and each protuberance is comprised of a short length along the longitudinal member of an upwardly sloping section from a plane, defined by the bottom surface of the member, followed by a section parallel to the plane and followed by a downwardly sloping section to the plane; and (ii) means for resiliently securing the longitudinal member within the conduit such that the force of the fluid flow will not displace the member, wherein means for resiliently securing the longitudinal member within the conduit comprises an upwardly sloped cantilevered segment extending from the plane defined by the bottom surface having, the segment having a width less than that of the longitudinal member and having a length sufficient for the upwardly sloped segment to contact the conduit wall and urge the planar bottom surface of the member against an opposite wall such that the member is self-secured within the conduit.

8. A heat transfer enhancement arrangement comprising:

(a) a conduit having a series of openings;

(b) a sleeve made of an elastic material located within the conduit such that when the sleeve is filled with a fluid the portion of the sleeve adjacent to the conduit openings will expand beyond the boundaries of the conduit and contact surfaces to be cooled;

(c) a self-securing turbulence-promoting device positioned within the interior of the sleeve, such that when the sleeve is filled with a moving fluid heat transfer is enhanced between the sleeve walls and the moving fluid, comprising:

(i) a longitudinal member having a plurality of protuberances for generating turbulent fluid flow within the sleeve; and (ii) means for resiliently securing the longitudinal member within the sleeve such that the force of the fluid flow will not displace the member.

* * * * *